US006936116B2

(12) United States Patent
Glatzel et al.

(10) Patent No.: US 6,936,116 B2
(45) Date of Patent: Aug. 30, 2005

(54) NICKEL-BASED ALLOY FOR PRODUCING COMPONENTS SOLIDIFIED IN SINGLE CRYSTAL FORM

(75) Inventors: Uwe Glatzel, Berlin (DE); Thomas Mack, Donauwoerth (DE); Silke Woellmer, Poppenrich (DE); Jürgen Wortmann, Weichs (DE)

(73) Assignee: MTU Aero Engines GmbH, Munich (DE)

( * ) Notice: Subject to any disclaimer, the term of this patent is extended or adjusted under 35 U.S.C. 154(b) by 0 days.

(21) Appl. No.: 10/041,759

(22) Filed: Jan. 10, 2002

(65) Prior Publication Data

US 2002/0182100 A1 Dec. 5, 2002

(30) Foreign Application Priority Data

Jan. 10, 2001 (DE) ..... 101 00 790

(51) Int. Cl.[7] ..... C22C 19/05
(52) U.S. Cl. ..... 148/428; 420/448; 420/454
(58) Field of Search ..... 420/448, 454; 148/428

(56) References Cited

U.S. PATENT DOCUMENTS 4,388,124 A 6/1983 Henry
4,721,540 A 1/1988 Harris et al. ..... 148/404
4,781,772 A * 11/1988 Benn et al. ..... 148/404
4,935,072 A * 6/1990 Nguyen-Dinh ..... 148/562
5,240,518 A * 8/1993 Wortman et al. ..... 148/404
5,270,123 A * 12/1993 Walston et al. ..... 428/652

FOREIGN PATENT DOCUMENTS

DE 4126989 8/1993
WO WO93/24683 12/1993

OTHER PUBLICATIONS

R. E. Smallman, et al., "Science, processes, applications" Metals and Materials, pp. 47–48.

* cited by examiner

*Primary Examiner*—John P. Sheehan
(74) *Attorney, Agent, or Firm*—Crowell & Moring LLP

(57) ABSTRACT

A nickel-based alloy for producing, by casting, components which have solidified in single crystal form, contains rhenium and tungsten, as well as aluminium, chromium and cobalt. The rhenium content is at least 2.3% by weight, and the weight ratio of the tungsten content to the rhenium content is at least 1.1 to at most 1.6.

14 Claims, No Drawings

NICKEL-BASED ALLOY FOR PRODUCING COMPONENTS SOLIDIFIED IN SINGLE CRYSTAL FORM

This application claims the priority of German patent document DE 101 00 790.6, filed Jan. 10, 2001, the disclosure of which is expressly incorporated by reference herein.

BACKGROUND AND SUMMARY OF INVENTION

The present invention relates to a nickel-based alloy for producing, by casting, components which have solidified in single crystal form.

Alloys of this type belong to a group of what are known as superalloys, which can be used at high temperatures and under high mechanical stresses and are therefore used in particular as turbine blade materials in gas turbines.

The future generation of aircraft engines with a high bypass ratio and a high-speed low-pressure turbine promises significant improvements in terms of fuel consumption and emissions. The weight of the engine, its size, and the maintenance costs are also current added-value parameters. Engines with a high bypass ratio are equipped with a reduction gear which is connected between the fan on one side and the low-pressure compressor and the low-pressure turbine on the other side. The gear allows the fan to be operated in the optimum range at low rotational speeds and offers the potential for operating the compressor and the turbine at higher rotational speeds and therefore higher pressure ratios than with conventional turbines. However, the higher circumferential speeds also increase the mechanical loads on the blades and discs of the low-pressure turbine.

Second and third generation Ni-based alloys for single-crystal components contain approximately 3% by weight or 6% by weight, respectively, of the refractory element rhenium and have better creep properties than alloys belonging to the first generation without any Re. The refractory element Re has different effects on the properties of superalloys. Re has a large atom radius, and consequently diffuses very slowly and segregates in the matrix. In addition to the effect of solid-solution hardening of the matrix, the rhenium atoms tend to form clusters, which prevent a dislocation motion.

Tungsten makes a considerable contribution to the solid-solution strengthening. The W content influences the distribution of the Re in the matrix and the γ' precipitation phase.

The high melting point and the low diffusion coefficient of both Re and W lead to an increase in the solidus temperature of the superalloys. Furthermore, the morphology change of the precipitation phase γ' is delayed under load.

Although the alloying element tantalum (Ta) contributes to the solid-solution strengthening and improves the cyclic oxidation behavior, it is primarily added to W-containing and Re-containing Ni-based alloys to counteract the formation of what are known as freckles during directional solidification.

Negative properties of Ta are a considerable increase in the density; it promotes the undesirable formation of TCP phases; and it increases the γ' solution annealing temperature.

The increase in the creep rupture strength is associated with a simultaneous increase in the density to 9 g $cm^{-3}$ for certain alloys containing 6% by weight of Re. In Re-free alloys, the density can be reduced to 8 g $cm^{-3}$. Ni-based alloys with a high relative density are, however, only of limited suitability for use in modern, high-speed aircraft turbines.

An Re-free superalloy with a low density is known, for example, from U.S. Pat. No. 4,721,540. The trade name of this material is "CMSX-6". Apart from the mechanical advantage of a relatively low density of 7.98 g $cm^{-3}$, however, this alloy also has drawbacks, such as a narrow heat treatment window and strong tendency to recrystallize.

Single-crystal castings, the alloy of which contains 0 to 8% by weight of rhenium, 3 to 10% by weight of tungsten and, inter alia, magnesium or calcium for increasing the resistance to oxidation, are known from international publication WO 93/24683. In a specific alloy composition, the Re content is to be 2.8 to 3.2% by weight, the W content is to be 5.6 to 6.2% by weight. Since rhenium and tungsten are heavy metals, this entails a relatively high component density, in particular if the upper limits of 8% by weight of rhenium and 10% by weight of tungsten are used. In addition, rhenium is a very expensive element, which has noticeable effects on the price of the components. The lower limit for Re is given in this document as 0% by weight. Although small quantities of Re reduce the weight and price, they lead to a considerable deterioration in important materials properties.

In view of these drawbacks, an object of the present invention is to provide nickel-based alloys for producing, by casting, components which have solidified in single crystal form, which alloys, through optimization of the rhenium and tungsten contents, allow particularly favourable materials and thus component properties, such as low density, high mechanical strength including low tendency to creep and high thermal stability, to be achieved. Further, it is necessary for the alloy to be easy to cast and to have favourable heat treatment properties.

DETAILED DESCRIPTION OF INVENTION

According to the present invention, the rhenium content is to be at least 2.3% by weight, and the tungsten to rhenium weight ratio is to be at least 1.1 and at most 1.6. Therefore, the alloy in question always contains more tungsten than rhenium, within a defined ratio range.

According to an embodiment of the present invention, an upper limit for the rhenium content is 2.6 wt. % with a view to limiting weight and costs in combination with very good materials properties. The range for the W to Re weight ratio is retained.

A specific alloy according to the present invention is referred to internally as "Leichter Einkristall 94" [Light Single Crystal 94] (LEK94), and has the following composition in % by weight:

| | | |
|---|---|---|
| Al | from 6.2 | to 6.8 |
| Co | from 7.2 | to 7.8 |
| Cr | from 5.8 | to 6.4 |
| Hf | from 0.05 | to 0.15 |
| Mo | from 1.7 | to 2.3 |
| Re | from 2.3 | to 2.6 |
| Ta | from 2.0 | to 2.6 |
| Ti | from 0.9 | to 1.1 |
| W | from 3.0 | to 3.7 |
| Ni | remainder, i.e. from 66.55 to 70.85. | |

Any impurities in the form of further elements or compounds are not taken into account here and may slightly change individual numerical values, such as, for example, the Ni content. It is also possible, for example, for the contents of the abovementioned elements to be subject to deviations, for example two places after the decimal point (hundredth of a percent), which will be known to a person skilled in the art and have no relevant influence on the materials properties.

This special material "LEK94" is a high-alloyed single-crystal alloy of low density which has been developed for use in high-speed turbines. To optimize the detrimental requirements of resistance to high temperatures and low density, the alloying contents of the Re and W have been varied.

The "LEK94" was developed with the following objects (starting point CMSX-6 in accordance with U.S. Pat. No. 4,721,540):

1. Improved recrystallization behavior;
2. Low density alloy with density $\rho \approx 8$ g/cm$^3$;
3. Avoiding a low-melting diffusion zone when coating;
4. Improved creep characteristics;
5. Satisfying general castability criteria and achieving an adequate solution annealing window; and
6. Low tendency to form TCP phases (brittle phases, $N_v$ criterion)

W and Re are added, but in smaller amounts than in known second generation Ni-based alloys. Further, the W and Re content is optimized (i.e., minimizing but determining a minimum level).

"LEK94" is an Re-containing single-crystal alloy of low density in the range from 8.1 to 8.3 g cm$^{-3}$ and of high thermal stability. This material is distinguished by good casting properties and a significantly sized heat treatment window.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A nickel-based alloy for producing components which have solidified in single crystal form, consisting essentially of:

at least 2.3% by weight rhenium;

3.0 to 3.7% by weight tungsten;

2.0 to 2.6% by weight of tantalum;

aluminium, chromium, cobalt, hafnium, molybdenum, titanium, and nickel, wherein a weight ratio of tungsten to rhenium is 1.1 to 1.6.

2. A nickel-based alloy for producing components which have solidified in single crystal form, consisting essentially of:

2.3 to 2.6% by weight rhenium;

2.0 to 2.6% by weight of tantalum;

aluminium, chromium, cobalt, hafnium, molybdenum, titanium, tungsten, and nickel, wherein a weight ratio of tungsten to rhenium is 1.1 to 1.6.

3. A nickel-based alloy according to claim comprising:

6.2 to 6.8% by weight of aluminum;

7.2 to 7.8% by weight of cobalt;

5.8 to 6.4% by weight of chromium;

0.05 to 0.15% by weight of hafnium;

1.7 to 2.3% by weight of molybdenum; and 0.9 to 1.1% by weight of titanium.

4. A gas turbine comprising a component comprising a nickel-based alloy according to claim 1.

5. A gas turbine according to claim 4, wherein the component is a blade in a high-speed turbine stage.

6. A nickel-based alloy according to claim 1, comprising 6.2 to 6.8% by weight of aluminum.

7. A nickel-based alloy according to claim 1, comprising 7.2 to 7.8% by weight of cobalt.

8. A nickel-based alloy according to claim 1, comprising 5.8 to 6.4% by weight of chromium.

9. A nickel-based alloy according to claim 1, comprising:

6.2 to 6.8% by weight of aluminum;

7.2 to 7.8% by weight of cobalt;

5.8 to 6.4% by weight of chromium;

0.05 to 0.15% by weight of hafnium;

1.7 to 2.3% by weight of molybdenum; and 0.9 to 1.1% by weight of titanium.

10. A nickel-based alloy according to claim 2, 6.2 to 6.8% by weight of aluminum.

11. A nickel-based alloy according to claim 2, comprising 7.2 to 7.8% by weight of cobalt.

12. A nickel-based alloy according to claim 2, comprising 5.8 to 6.4% by weight of chromium.

13. A gas turbine comprising a component comprising a nickel-based alloy according to claim 2.

14. A gas turbine according to claim 13, wherein the component is a blade in a high-speed turbine stage.

* * * * *

UNITED STATES PATENT AND TRADEMARK OFFICE

CERTIFICATE OF CORRECTION

PATENT NO. : 6,936,116 B2
DATED : August 30, 2005
INVENTOR(S) : Uwe Glatzel et al.

It is certified that error appears in the above-identified patent and that said Letters Patent is hereby corrected as shown below:

Column 4,
Lines 9-15, change claim 3 to read:

3. A nickel-based alloy according to claim 2, comprising:
6.2 to 6.8% by weight of aluminum;
7.2 to 7.8% by weight of cobalt;
5.8 to 6.4% by weight of chromium;
0.05 to 0.15% by weight of hafnium;
1.7 to 2.3% by weight of molybdenum; and
0.9 to 1.1% by weight of titanium.

Signed and Sealed this

Sixth Day of June, 2006

JON W. DUDAS
*Director of the United States Patent and Trademark Office*